US006708860B1

(12) United States Patent
Thieleke

(10) Patent No.: US 6,708,860 B1
(45) Date of Patent: Mar. 23, 2004

(54) SETTING TOOL FOR FASTENING ELEMENTS

(75) Inventor: Joachim Thieleke, Wasserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/680,140

(22) Filed: Oct. 4, 2000

(30) Foreign Application Priority Data

Oct. 19, 1999 (DE) ..... 199 50 349

(51) Int. Cl.[7] ..... B27F 7/17

(52) U.S. Cl. ..... 227/8; 227/119; 227/120; 227/136

(58) Field of Search ..... 227/8, 120, 119, 227/136, 123

(56) References Cited

U.S. PATENT DOCUMENTS 3,820,703 A * 6/1974 Rangger ..... 227/10
3,863,824 A * 2/1975 Bakoledis ..... 227/10
4,051,990 A * 10/1977 Chromy et al. ..... 227/10
4,374,567 A * 2/1983 Combette et al. ..... 227/10
4,711,385 A * 12/1987 Jochum ..... 227/10
4,930,673 A * 6/1990 Pfister ..... 227/10
4,932,580 A * 6/1990 Pfister et al. ..... 227/10
5,136,921 A * 8/1992 Buchel ..... 89/1.14
5,220,123 A * 6/1993 Oehry ..... 89/1.14
5,579,975 A * 12/1996 Moorman ..... 227/8
6,027,004 A * 2/2000 Ramella et al. ..... 227/136
6,053,388 A * 4/2000 Pfister et al. ..... 227/10
6,267,284 B1 * 7/2001 Clark ..... 227/8

* cited by examiner

*Primary Examiner*—Scott A. Smith
*Assistant Examiner*—Louis Tran
(74) *Attorney, Agent, or Firm*—Sidley Austin Brown & Wood, LLP

(57) ABSTRACT

A setting tool for driving fastening elements into constructional components and parts and including a guide tube (3) for guiding a fastening element out, a device for displacing the fastening element through the side cut-out (13) formed in the guide tube (3) into interior of the guide tube (3), and a feeler element extending into the interior of the guide tube (3) opposite the side cut-out (13) with a depth by which the feeler element extends into the interior of the guide tube (3) being determined by a fastening element to-be-displaced into the interior of the guide tube (3).

1 Claim, 3 Drawing Sheets

SETTING TOOL FOR FASTENING ELEMENTS

BACKGROUND OF THE INVENTION

1. Field of the Invention

The present invention relates to a setting tool for driving-in fastening elements and, in particular, to a portable, internal combustion engine-driven setting tool including a guide tube for guiding a fastening element out of the tool and having a side cut-out through which a fastening element is displaced into the guide tube interior.

2. Description of the Prior Art

For pushing a fastening element out of a guide tube, a piston rod of a piston is driven into the guide tube for impacting the fastening element. A piston plate, which is secured on the piston rod is connected with a combustion chamber in which a driving power is generated upon ignition of a suitable combustible gas mixture, e.g., air/fuel gas mixture.

For safety reasons, in this type of setting tools often, there is provided a pressing sleeve displaceable over the guide tube. The pressing sleeve insures that the setting process, i.e., driving of a fastening element in an object can only then take place when the setting tool is pressed against the object. Upon the setting tool being pressed against an object, the pressing sleeve is displaced rearward with respect to the guide tube against a biasing force. The pressing sleeve, upon being displaced interact with mechanical and/or electrical switches which actuate an actuation element or trigger and/or provide for release of the drive energy only then when the pressing sleeve is depressed by a certain minimal amount.

The setting tools of this type are often equipped with magazines containing fastening elements and further include additional elements for determining, before initiating the setting process, if a magazine is mounted on the tool, if the number of fastening elements in the magazine is sufficient, if the fastening elements are correctly positioned in the magazine or the guide tube. Preferably, the fastening elements are arranged in strips in belt-like manner and in this condition are mounted in a tool magazine. The displacement of the magazine is effected under action of a biasing force for successively displacing the fastening elements in the interior of the guide tube so that they can be driven in an object.

An object of the present invention is to provide simple means for effecting one or several of the above-listed determining functions.

SUMMARY OF THE INVENTION

This and other objects of the present invention, which will become apparent hereinafter, are achieved by providing a feeler element extending into the interior of the guide tube opposite the side cut-out formed in the guide tube, with a depth by which the feeler element extends into the interior of the guide tube being determined by a fastening element to-be-displaced into the interior of the guide tube.

The depth, by which the feeler element extends into the interior of the guide tube permits to determine whether a fastening element has be displaced into the guide tube and whether, if displaced, is correctly positioned therein. If there is no fastening element in the guide tube or it has not been pushed into the guide tube out of the magazine sufficiently far, the feeler element would extend into the interior of the guide tube only so far that an initiation of the setting process and of the ignition of the combustible mixture in the combustion chamber would not be possible. In other words, the operation of the setting tool would be blocked until a fastening element is properly positioned in the guide tube in a position corresponding to a minimal depth by which the feeler element can extend into the interior of the guide tube.

According to one embodiment of this invention, the feeler element is formed as a section of a pawl pivotable in a plane containing the central axis of the guide tube, with pawl being pivotable about an axis extending transverse to the plane containing the central axis and having a locking edge which prevents displacement of a pressing sleeve displaceable over the guide tube in absence of a fastening element in the guide tube.

The feeler element according to the present invention provides simple means for blocking operation of the setting tool. If there is no fastening element in the setting tool or the fastening element is improperly positioned, the depth, by which the feeler element extends into the interior of the guide tube, exceeds a predetermined minimal depth. In this position of the feeler element, the locking edge lies in the displacement path of the pressing sleeve, preventing its displacement inside the tool when the tool is pressed against an object. The ignition of the combustible mixture is not possible until the pressing sleeve reaches its end position in which the ignition can take place.

Only when a fastening element is correctly positioned in the guide tube, the feeler element extends into the interior of the guide tube by a predetermined minimal depth and enables a rearward displacement of the pressing sleeve to its end position upon pressing the tool against an object so that ignition of the combustible mixture or firing of the tool becomes possible.

According to a further embodiment of the present invention, the pawl has an adjusting edge located between the locking edge and the feeler section and extending at an angle relative to the guide tube. The pressing sleeve is displaced along the adjusting edge for pivoting the feeler section out of the interior of the guide tube. Before the pressing sleeve reaches its rearward end position which provides for firing of the tool, the pawl is pivoted further away from the guide tube, and the feeler section is completely displaced out of the guide tube. As a result, a piston rod, displaceable, upon firing of the tool, into the guide tube, would not have any contact with the feeler section, whereby damage of the feeler section and/or the piston rod is prevented.

Preferably, the pawl is spring-biased in a direction toward the guide tube so that upon the fastening element leaving the guide tube and the piston rod moved to its initial position, the pawl is also pivoted into its initial position.

The novel feature of the present invention, which are considered as characteristic for the invention, are set forth in the appended claims. The invention itself, however, both s to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
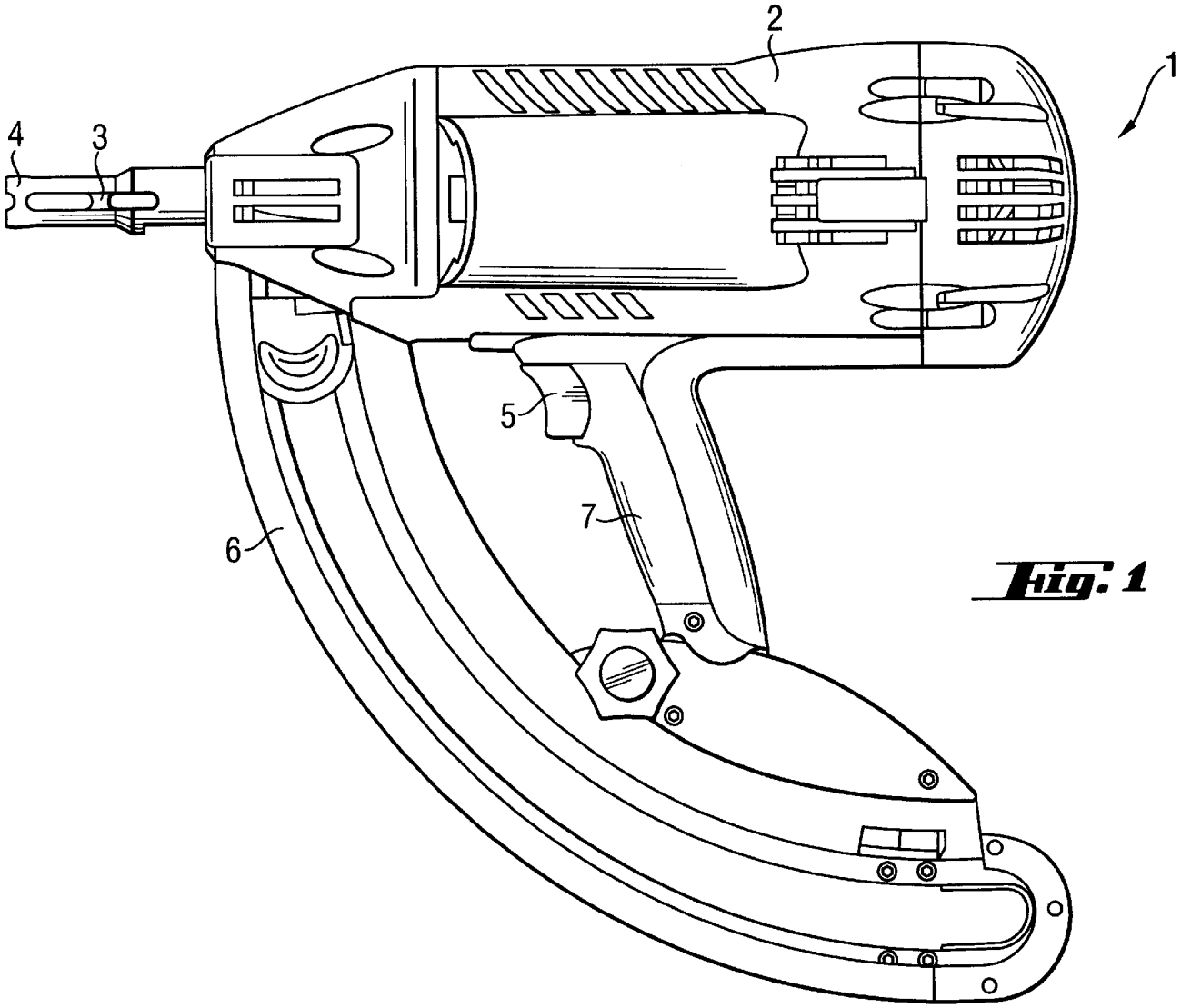
FIG. 1 a side view of a setting tool according to the present invention.

A setting tool 1 according to the present invention, which is shown in FIG. 1, includes a housing 2, a guide tube 3 and a pressing sleeve 4 projecting out of the housing 2. The pressing sleeve 4 is concentrically slidably mounted on the guide tube 3 and is displaceable into the interior of the housing 2 against a biasing force when is pressed against an object into which a fastening element is to be driven-in. When the pressing sleeve 4 reaches its rear end position, the setting tool is unlocked and the drive-in process of a fastening element can begin upon actuation of a trigger 5. Upon actuation of the trigger 5, a combustion mixture, e.g., air/fuel gas mixture, which fills a combustion chamber, can be ignited with an electrical ignition device for driving a piston plate which is connected with a piston rod. Thereby, the piston rod is driven into the guide tube 3 for pushing a fastening element located there-in out. The fastening elements are located in a magazine 6 in strips in a bell-like manner, with fastening elements. The magazine 6 extends from a front section of the tool to a handle 7.

Figure 2:
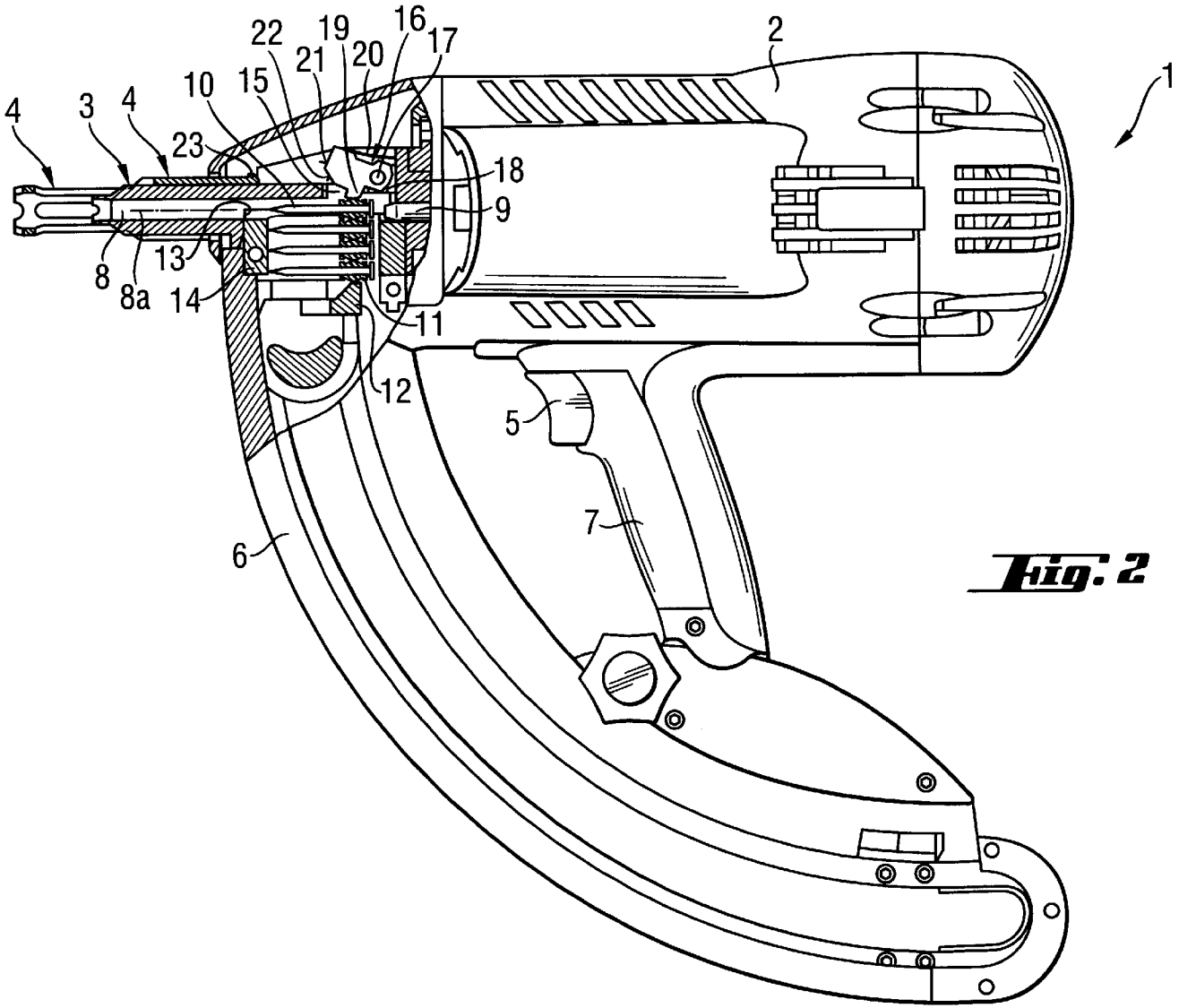
FIG. 2 a side view similar to that of FIG. 1 with a cross-sectional view of the front region of the tool.

As shown in FIG. 2 which, as discussed above, shows a cross-section of the front region of the inventive setting tool, an inner channel 8 of the guide tube 3 is aligned with the piston rod 9 which is being driven into the inner channel 8. At its rear end, the piston rod 9 is connected with a piston plate which in turn is connected with a combustion chamber (not shown), whereby the piston plate is subjected to a pressure force generate upon the combustion of the air/fuel gas mixture in the combustion chamber. As discussed above, upon actuation of the trigger 5, the air/fuel gas mixture in the combustion chamber is ignited with the electrical ignition device, with the generated pressure acting on the piston plate which results in displacement of the piston rod 9 into the inner channel 8 of the guide tube 3, with the piston rod 9 pushing a fastening element 10, which is located in the inner channel 8, out of the channel 8. This, however, is only then possible when the pressing sleeve 4 has been sufficiently pressed against the object, into which the fastening element is being driven in, and has been displaced, as a result, to it rear end position. Only then, actuation of the trigger 5 results in the release of an electrical or mechanical lock.

As discussed above, the fastening elements 10 are arranged in the magazine 6 in strips of fastening elements. Here, the fastening elements 10 are nails carrying in their head regions a collar 11 formed of a plastic material. The plastic collars 11 connect the fastening elements 10 with each other. A spring-biased pressing device 12, which is located in the magazine 6, biases the fastening element strip in a direction toward the guide tube 3 so that a front-most fastening element 10 is always pressed into the guide tube 3 through as cut-out 13 in the guide tube wall. A head member 14 is arranged in the cut-out 13, with the fastening elements 10 reaching the channel 8 there past. There is further provided a stop for the pressing device 12 and which absorbs the biasing force acting on the pressing device 12. In this case, a small number of fastening elements is still located between the guide tube 3 and the pressing device 12 which, at that stage, cannot be pushed further in the direction toward the guide tube 3. This is necessary in case when for the release of the pressing sleeve 4, a certain minimal number of the fastening elements 10 need be present in the magazine 6. In the embodiment shown in FIG. 2, the minimal number of the fastening elements 10, which need be present in the magazine 6, is four.

FIG. 2 shows that in the wall of the guide tube 3, there is provided, opposite the cut-out 13, another cut-out 15. The cut-out 15 is located opposite the collars 11 of the fastening elements 10. The cut-out 15, thus, is located in the rear region of the guide tube 3 or the head member 14. The tool 1 further includes a plate-shaped locking pawl 16 lying in a plane of the central axis of the guide tube 3. The locking pawl 16 pivots about a pivot axis 17 which extends perpendicular to the plane of the locking pawl 16 which coincides with the plane of the central axis 8*a* of the guide tube 3. The separate fastening elements 10 are displaced toward the inner channel 8 also in the plane of the central axis of the guide tube 3, with the fastening elements 10 extending parallel to the central axis of the guide tube 3. In FIG. 2, this plane is the plane of the drawing. The pivot axis 17 is located outside of the guide tube 3, on a radial shoulder 18 connected with the guide tube 3. Thus, the locking pawl 16 is located outside of the guide tube 3 and has a free end facing the cut-out 15 of the guide tube 3. At its lower edge facing the guide tube 3, the locking pawl 16 has a feeler section 19. The feeler section 19 projects into the inner channel 8 when the free end of the locking pawl 16, e.g., lies on the circumferential edge of the cut-out 15 formed in the guide tube 3. A compression spring 20 constantly biases the locking pawl 16 toward the guide tube 3 about the pivot axis 17.

When there is no fastening element 10 in the inner channel 8 of the guide tube 3, the compression spring 20 biases the locking pawl 16 abuts the pivot axis 17 in counter clockwise direction toward the 9 guide tube 3, and the free end of the locking pawl 16 abuts the edge limiting the cut-out 15. The feeler section 19 does not encounter any object in the inner channel 8 which would obstruct the movement of the feeler section 19. The free end of the locking pawl 16, in the case, lies in the displacement path of the pressing sleeve 4 and prevents the pressing sleeve 4 from reaching its inner or rear end position when the setting tool 1 is pressed with the pressing sleeve 4 against an object. The operation of the setting tool 1 or its drive mechanism is not possible. As a result, the pressing sleeve 4 cannot rotate the locking pawl 16 about the pivot axis 17 in the clockwise direction even when being forcefully pressed against the object as, in this case, self-locking takes place. In this case, the pressing sleeve 4 impacts the locking pawl at a point which is located in FIG. 2 beneath the pivot axis 17.

Figure 3:
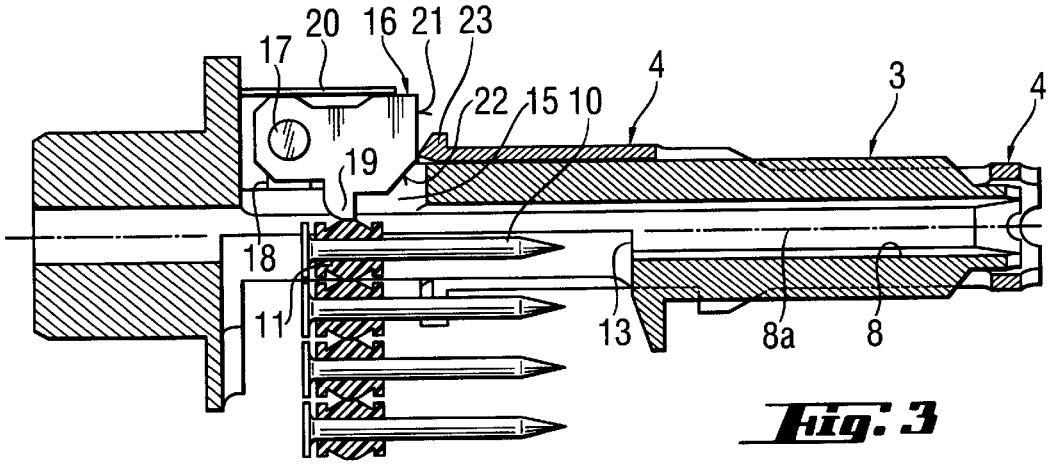
FIG. 3 an axial cross-sectional view of the guide tube and the pressing sleeve in the fastening element feed region with incorrect positioning of the fastening element.
Figure 4:
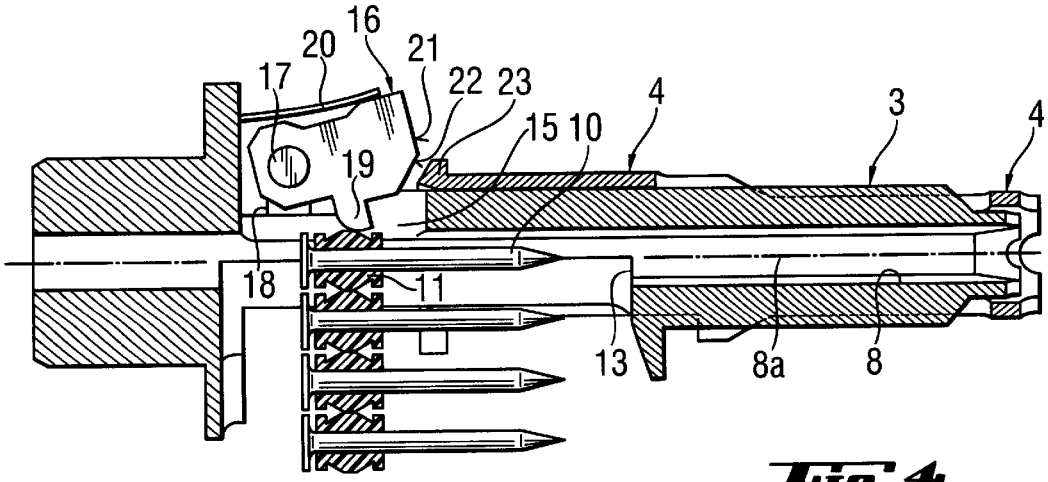
FIG. 4 a view similar to that of FIG. 3 with correct positioning of the fastening element.
Figure 5:
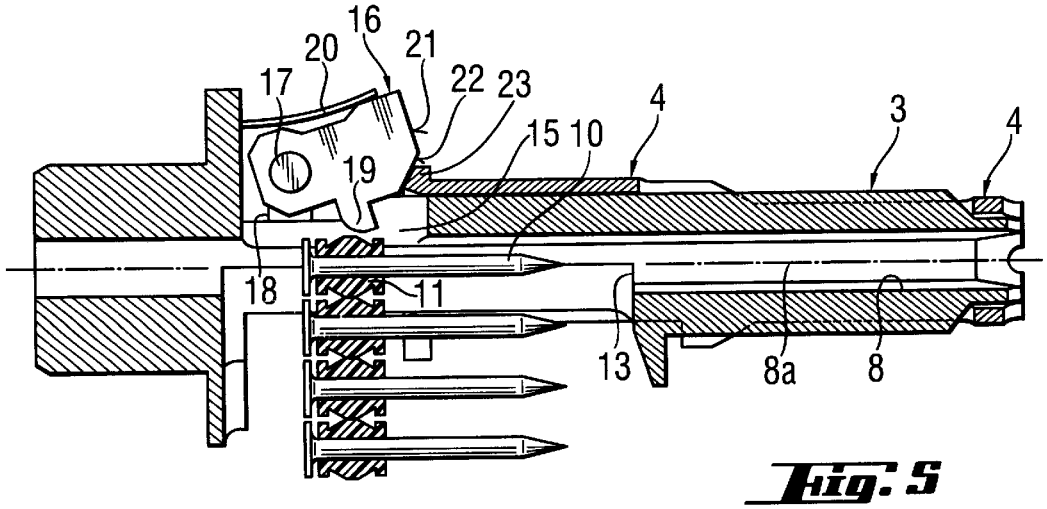
FIG. 5 a view similar to that of FIG. 4 with correct positioning of the fastening element and with a feeler section of the locking pawl being completely withdrawn form the inner channel of the guide tube.

FIGS. 3–5 show different positions of the locking pawl 16 and the pressing sleeve 4 when a fastening element 10 is located in the inner channel 8.

FIG. 3 show respective positions when the fastening element 10 has not penetrated in the inner channel 8 of the guide tube 3 sufficiently far under the action of the pressing device 12 in the magazine 6. The locking pawl 16, in this case, can pivot about the pivot axis 17 in the clockwise direction so far that the free end of the locking pawl 16 facing the mount of the guide tube 3 lies in the displacement path of the pressing sleeve 4. In other words, the edge of the free end of the locking pawl 16 lies in the displacement path of the sleeve 4. This edge, which is designated with a reference numeral 21, in this case, extends somewhat transverse to the guide tube 3. The pressing sleeve 4 still cannot be displaced to its rear or unlocking position, and actuation of the tool is still not possible.

In FIG. 4, the fastening element 10 is located in the inner channel 8 so that it lies along the central axis 8*a* of the guide tube 3. The feeler section 19 of the locking pawl 16 is pressed by the collar 11 on the fastening element 10 upward against a biasing force of the spring 20, and the locking pawl 16 is pivoted about the pivot axis 17 in the counter clockwise direction. Thereby, the front edge 21 is pivoted out of the displacement path of the pressing sleeve 4, and the sleeve 4 can be displaced to its rear end position.

FIG. 5 shows a position shortly before the pressing sleeve 4 reaches its rear end or unlocking position. The sleeve 4 presses the inclined adjusting edge 22 in the front region of the locking pawl 16 and further pivots the locking pawl 16 in the counter clockwise direction to an extend that the feeler section 19 is completely lifted of the inner channel 18 and does not contact the collar 11 on the fastening element 10. In the end position of the pressing sleeve 4, actuation of the ignition mechanism becomes possible. The piston rod 9, upon ignition of the explosive powder charge, is displaced into the inner channel 8 and drives the fastening element 10 out of the guide tube 3, without contacting the feeler section 19 of the locking pawl 16. In this manner the feeler section 19 and the piston rod 9 are both protected from damage. The adjusting edge 22 extends approximately at an angle of 45 to the front edge 21 and is lifted by the rear portion 23 of the pressing sleeve 4.

Though the present invention was shown and described with references to the preferred embodiments, such are merely illustrative of the present invention and are not to be construed as a limitation thereof and various modification of the present invention will be apparent to those skilled n the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A setting tool for driving fastening elements into constructional components and parts, comprising a guide tube (3) for guiding a fastening element out and having a side cut-out (13); means for displacing the fastening element through the side cut-out (13) into interior of the guide tube (3); a feeler element extending into the interior of the guide tube (3) opposite the side cut-out (13) formed in the guide tube (3), with a depth by which the feeler element extends into the interior of the guide tube (3) being reduced by a fastening element displaceable into the interior of the guide tube (3) through the side cut-out (13); a pivotable pawl (16) for preventing operation of the tool in absence of a fastening element in the interior of the guide tube (3), the feeler element forming a section of the pawl (16); and spring means (20) for biasing the pawl (16) in a direction toward the guide tube (3), wherein the pawl (16) pivots in a plane containing the central axis (8*a*) of the guide tube (3), wherein the setting tool further comprises a pressing sleeve (4) slidably displaceable over the guide tube (3), into a tool housing (2) and the pawl (16) pivots about an axis (17) extending transverse to the plane containing the guide tube central axis (8*a*) and has a locking edge (21) for preventing displacement of the pressing sleeve (4) into a tool housing (2) in the absence of fastening element in the interior of the guide tube (3), and wherein the pawl (16) has an adjusting edge (22) located between the locking edge (21) and the feeler section (19) and extending at an angle relative to the guide tube (3), the pressing sleeve (4) displacing along the adjusting edge (22) for pivoting the feeler section (19) out of the interior of the guide tube (3).

* * * * *